United States Patent [19]

Rubik

[11] 4,410,179

[45] Oct. 18, 1983

[54] SHIFTABLE ELEMENT PUZZLE

[75] Inventor: Erno Rubik, Budapest, Hungary

[73] Assignee: Konsumex Külkereskedelmi Vállalat, Budapest, Hungary

[21] Appl. No.: 319,599

[22] Filed: Nov. 9, 1981

[30] Foreign Application Priority Data

Nov. 9, 1980 [HU] Hungary ..... 2679

[51] Int. Cl.[3] ..... A63F 9/08

[52] U.S. Cl. ..... 273/153 S

[58] Field of Search ..... 273/153 R, 153 S, 155

[56] References Cited

FOREIGN PATENT DOCUMENTS

| | | | |
|---|---|---|---|
| 170062 | 12/1977 | Hungary | 273/153 S |
| 2084471 | 4/1980 | United Kingdom | 273/153 S |
| 2084472 | 4/1982 | United Kingdom | 273/153 S |
| 2087245 | 5/1982 | United Kingdom | 273/153 S |

*Primary Examiner*—Anton O. Oechsle

*Attorney, Agent, or Firm*—Gabriel P. Katona

[57] ABSTRACT

The invention concerns a shiftable element logical puzzle in the form of a cylindrical body comprised of an assembly of sector shaped cylinder forming elements, said elements forming two identical cylinder halves in the form of upper and lower tiers of six elements each, three of said elements in each tier being identical to each other, but different from the remaining elements, and means joining said elements together to form said cylindrical body and enabling various groupigs of six elements, three from each tier, to rotate relative to the remaining three identical elements about three axes passing through the cylinder body axis but perpendicular thereto.

4 Claims, 6 Drawing Figures

SHIFTABLE ELEMENT PUZZLE

BACKGROUND OF THE INVENTION

The invention relates to a spatial logical toy which, when the components are assembled, form a cylindrical body fitted together from two half-cylinders, each half part consisting of seven elements. Six of the elements represent the actual toy, while the seventh, suitably spherical, element is a centrally arranged connecting piece.

The toy elements are shaped solids. Their top view shows a sector, actually such spatial segments which are brought about by the section planes along the three diameters of the cylinder end surface.

The toy elements with the centrally arranged connecting piece together with a flexible, joined joining element made from a single piece are interconnected in such a way, that each toy element can be rotated around the spatial centerlines of the logical toy along the limiting line of the sector-shaped pieces.

The logical toy according to the invention consists of two half-parts along the section plane parallel with the cylinder's end surface, which through the connecting surfaces formed on the circumference of the circular portion can be fitted together by snapping them together to form a closed cylindrical unit.

Spatial logical toys are already known, such as the one described in the Hungarian patent specification No. 170 062, in which a preferable construction is in the form of a cube. This cube is formed by smaller cubes, the corners of which point towards the geometrical center of the large cube, and are joined, shaped solids, interconnected by flexible, centrally arranged connecting pieces, and can be rotated along the spatial centerlines of the large cube. This way an extremely large number of variations are possible.

SUMMARY OF THE INVENTION

One of the possible further developments of this spatial logical toy is the one that is the subject of this invention and which is formed according to an identical construction method.

The identical construction method is understood as having a connecting element in the geometrical center of the spatial logical toy, to which the toy elements are connected with the aid of a joining element, and these toy elements can be rotated around the spatial centerlines of the logical body along the diameters separating the sectors from each other.

The invention concerns a shiftable element logical puzzle in the form of a cylindrical body comprised of an assembly of sector shaped cylinder forming elements, said elements forming two identical cylder halves in the form of upper and lower tiers of six elements each, three of said elements in each tier being identical to each other, but different from the remaining elements, and means joining said elements together to form said cylindrical body and enabling various groupings of six elements, three from each tier, to rotate relative to the remaining three identical elements about three axes passing through the cylinder body axis but perpendicular thereto.

Since according to the invention the cylindrical toy is assembled from two identical half-parts, the altogether six space segments of the assembled cylinder can be painted with six different diagrams, symbols, etc. and at the same are applied on the lower circular surface of the cylinder. By rotating the space segments a large number of variations can be played according to the rules of the game, and thus the realization of entertaining toys developing logical thinking is equally possible for children and adults.

Thus the invention is aimed at solving the problem of the construction of such a spatial logical toy, the design principle of which is identical with that of the logical toy described in the patent specification No. 170 062, but formation of both the toy elements, connecting elements and joining element, and at the same time the appearance of the assembled toy, are entirely different.

Formation of the toy elements and connecting element as well as that of the flexible joining element is described in detail with the aid of the enclosed drawings, in which:

DETAILED DESCRIPTION OF THE INVENTION

Figure 1:
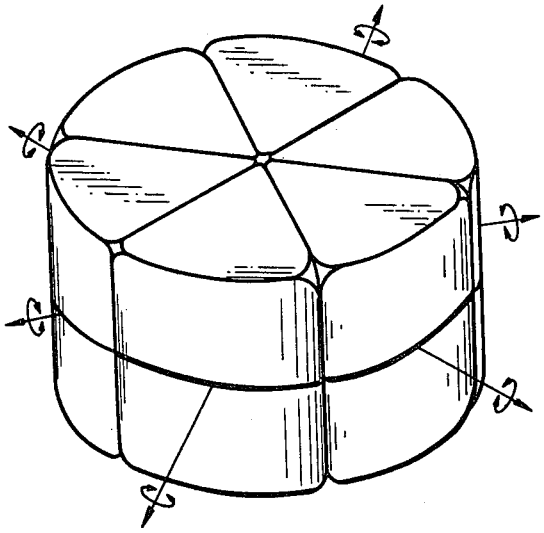
FIG. 1 is the logical toy according to the invention in the assembled state.
Figure 3:
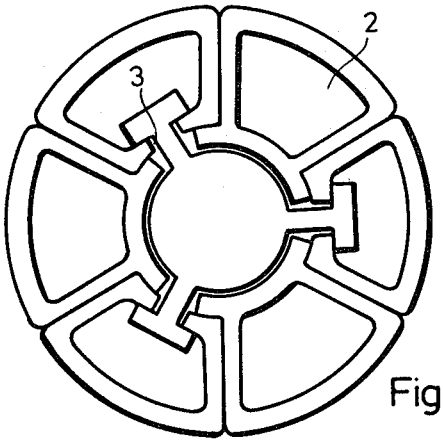
FIG. 3 is a horizontal section through the center of the cylinder jacket.
Figure 2:
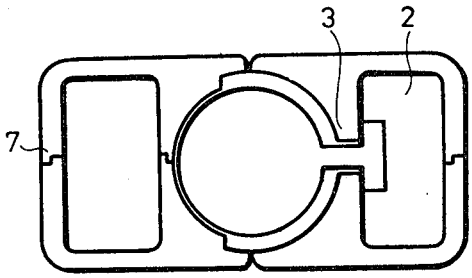
FIG. 2 is a cross section of the logical toy along one of the end surfaces of the cylinder.
Figure 4:
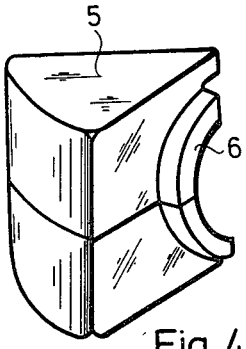
FIG. 4 is perspective view showing one of the identical three toy elements of a first group in the spatial logical toy.
Figure 5:
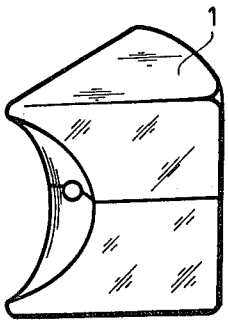
FIG. 5 is a perspective view showing one of the identical toy elements in a second group.
Figure 6:
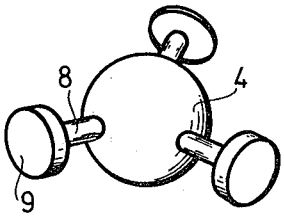
FIG. 6 is a flexible joining element.

The centrally arranged connecting element is spherical and is not shown separately in the drawings.

The three toy elements 1 of a first group are joined, shaped solids. Their form in top view is that of a sector. The toy element 1 is hollow inside. The cavity is formed in such a way, that trough 2 following the line of the circular arc is machined on the part of the cylinder segment facing the outer circular arc, said trough 2 continues in the semi-circular passage 3 in the direction of the center of the circle. The internal part of the passage and thus that of the whole segment is cut off at the centrally arranged connecting element 4, i.e. its part ending at the sphere is cut off along the curve corresponding to the circular arc pertaining to the radius of the curvature of the sphere.

The three identical toy elements 5 of the second group are similarly joined, shaped solids, which in top view are confined by a sector-shaped piece. In the range of the toy elements 5 pointing towards the connecting element 4, protrusions 6 are formed on both sides of the solids. These protrusions 6 fit into the recesses of the same shape machined within the same range of the toy elements 1 of the first group.

As mentioned, the spatial cylindrical logical toy is formed from two half parts. The other half part is formed identically with the half part described above. The two half parts can be assembled to a complete unit by snapping them together with the flanges 7 of the toy elements fitting into each other.

Prior to assembly of the two half parts, the joining element 8 formed from a single piece together with the centrally arranged connecting element 4 is placed into the passage machined in the three toy elements 1 of the first group. The material of the joining element 8 is flexible and it consists of three cylindrical rods protruding radially from the spherical connecting element 4 at 120° in relation to each other, and in the horizontal plane. Furthermore, it consists of discs 9 at the end of each rod. The discs 9 are arranged in the trough 2, and the cylinders are arranged in passages 3 machined in the toy elements 1.

Upon snapping together the two half parts, the logical toy according to the solution of the invention, is in the assembled state, and with the centrally arranged connecting element 4, furthermore with the joining element 8, the toy elements can be rotated along the diameters separating the toy elements from each other. In order to realize the rotation, the joining element 8 is suitably made of flexible synthetic material.

The spatial logical toy according to the invention, similarly with respect to the spatial logical toys constructed according to an identical construction method, offers a solution for extremely variable and entertaining problems. Formation of the toy elements in a spatial segment shape offers variations of new space perception.

If relief-type diagrams are formed on the surface of each toy element, then a toy is available offering entertainment suitable even for the blind.

I claim:

1. A shiftable element logical puzzle in the form of a cylindrical body comprised of an assembly of sector shaped cylinder forming elements, said elements forming two identical cylder halves in the form of upper and lower tiers of six elements each, three of said elements in each tier being identical to each other, but different from the remaining three identical elements, and means joining said elements together to form said cylindrical body and enabling various groupings of six elements, three from each tier, to rotate relative to the remaining elements about three axes passing through the cylinder body axis but perpendicular thereto.

2. The shiftable element logical puzzle of claim 1, wherein said means for joining said elements together comprises a centrally arranged connecting element in the form of a sphere and puzzle element joining elements in the form of three flexible rods protruding radially from said sphere, said rods being disposed in the same plane and at 120 degrees with respect to each other, and a disk at the end of each rod.

3. The shiftable element logical puzzle of claim 2, wherein each of said first named three identical puzzle elements in each tier is joined to a like identical element in the other of said tiers to form a pair of elements each joined pair being sector shaped with the pointed end thereof being arcuately recessed to match the curvature of said sphere, said arcuate recess being provided with laterally directed flanges, and said recess and flanges being in sliding abutting relationship with said sphere.

4. The shiftable element logical puzzle of claim 3, wherein each of said remaining three identical puzzle elements in each tier is joined to a like identical element in the other of said tiers to form a pair of remaining joined elements, each said joined pair of remaining elements being sector shaped with the pointed end thereof being arcuately recessed to conform to the curvature of said flanges, each said joined pair of remaining elements being hollow and provided with an opening centrally of said arcuate recess, each said flexible rod passing through one of said openings and each said disk disposed within a hollow pair of said remaining elements with the arcuate recess of each pair of remaining elements slidingly abutting the flanges of adjacent pairs of said first named puzzle elements.

* * * * *